US005515781A

United States Patent [19]

Songer

[11] Patent Number: 5,515,781

[45] Date of Patent: May 14, 1996

[54] NICKEL PRINTING SLEEVE WITH PROTECTIVE HARD RUBBER RIMS

[75] Inventor: Richard F. Songer, Ellicottville, N.Y.

[73] Assignee: Luminite Products Corporation, Salamanca, N.Y.

[21] Appl. No.: 512,303

[22] Filed: Aug. 8, 1995

[51] Int. Cl.[6] ..... B41N 1/12

[52] U.S. Cl. ..... 101/401.1; 101/375; 156/322; 156/86; 492/4; 492/28; 492/47

[58] Field of Search ..... 101/375, 401.1; 156/86, 322; 492/4, 28, 47; 29/113.1

[56] References Cited

U.S. PATENT DOCUMENTS

| | | | |
|---|---|---|---|
| 4,381,961 | 5/1983 | Van Der Velden | 101/375 |
| 4,461,663 | 7/1984 | Tachibana et al. | 101/375 |
| 4,794,858 | 7/1989 | Katz | 101/375 |
| 5,247,884 | 9/1993 | Rid | 101/401.1 |
| 5,256,459 | 10/1993 | Carlson | 101/375 |
| 5,301,610 | 4/1994 | McConwell | 101/401.1 |
| 5,347,927 | 9/1994 | Berna et al. | 101/401.1 |

*Primary Examiner*—Eugene H. Eickholt
*Attorney, Agent, or Firm*—Joseph P. Gastel

[57] ABSTRACT

A printing sleeve including a nickel sleeve having an inner surface and an outer surface and opposite end portions and opposite ends, and hard rubber rims bonded to the outer surface at the end portions and having rim portions extending beyond the opposite ends of the nickel sleeve and bonded thereto, and inner surfaces on the rim portions which are substantially in line with the inner surface of the nickel sleeve. A method of bonding a hard rubber rim onto each end of a nickel printing sleeve comprising the steps of applying an adhesive to each end and end portion of the sleeve, inserting a plug into each end of the sleeve, winding an unvulcanized rubber strip around each end portion of the sleeve and onto the play, and heating each rubber strip to cause it to cure and bond to the end portion of the sleeve.

27 Claims, 4 Drawing Sheets

Fig. 1.
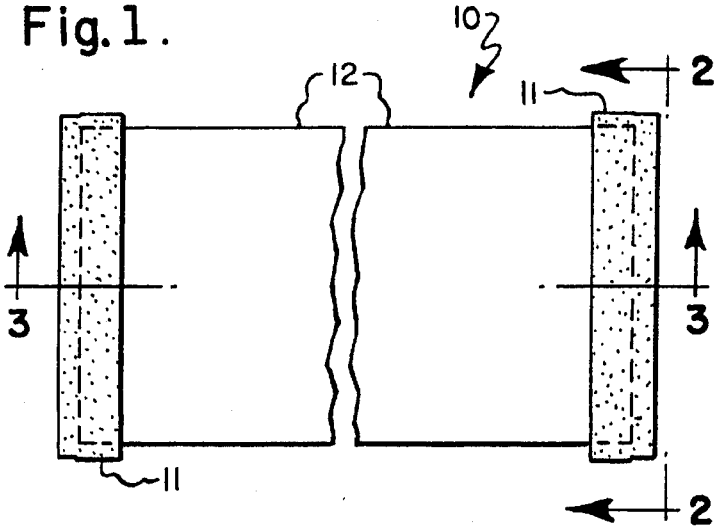
Fig. 2.
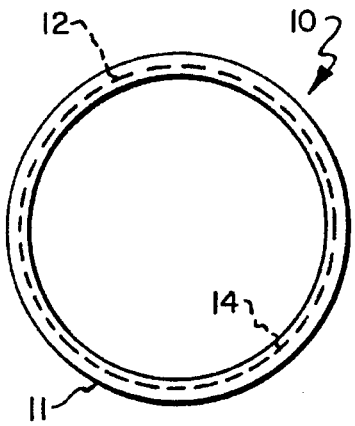
Fig. 3.
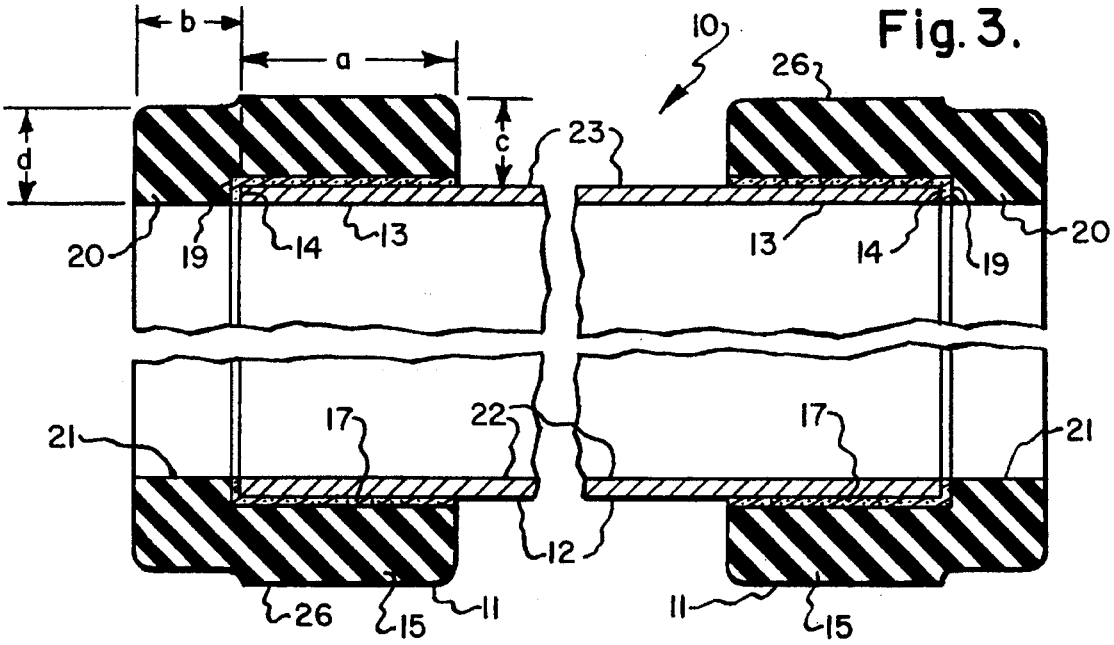
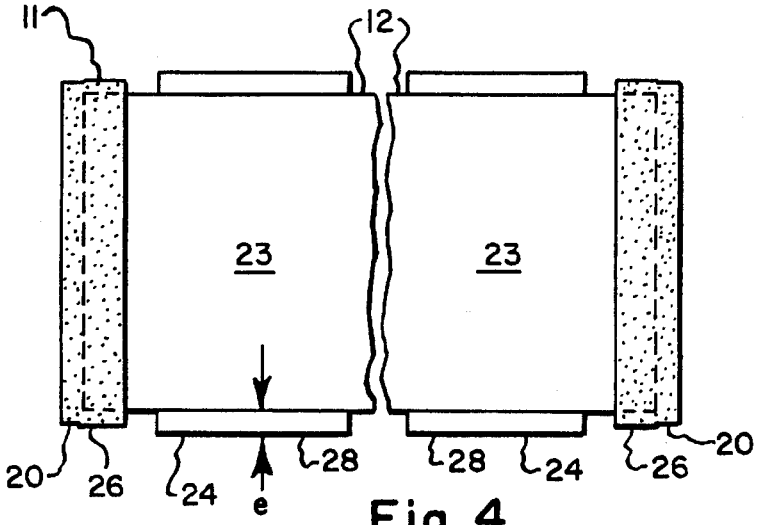
Fig. 4.
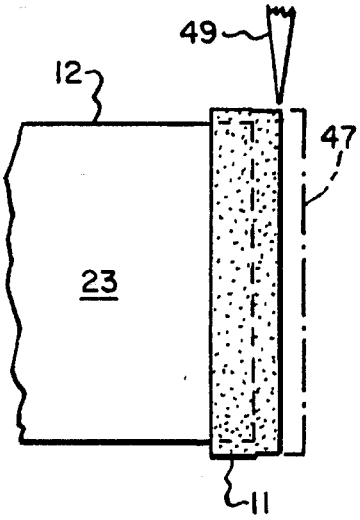
Fig. 9.

Fig. 5.
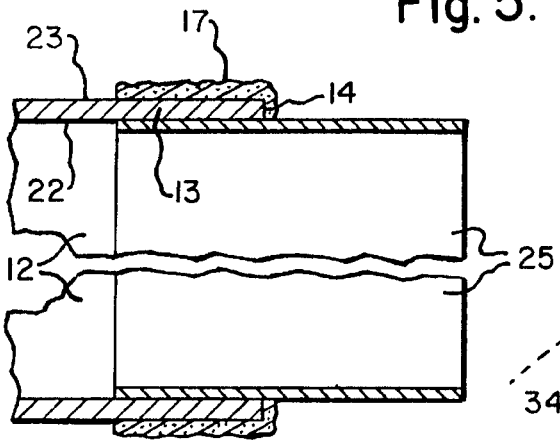
Fig. 8.
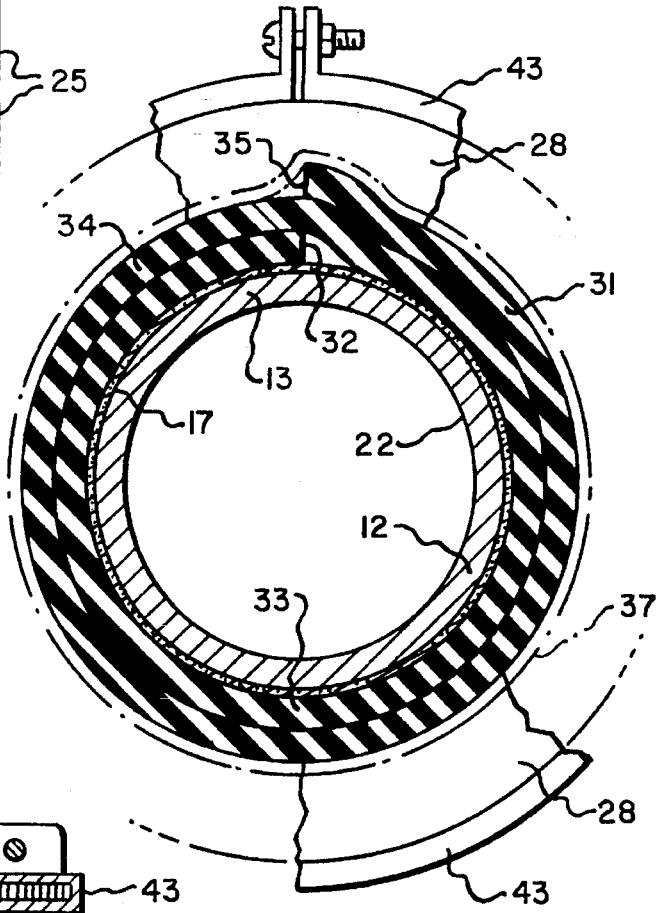
Fig. 6.
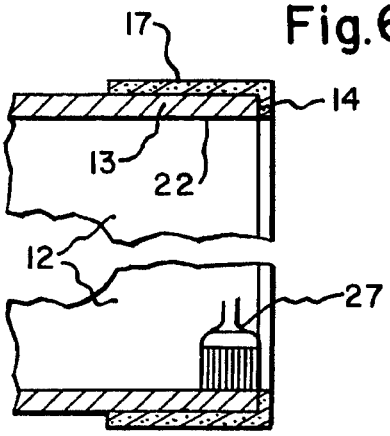
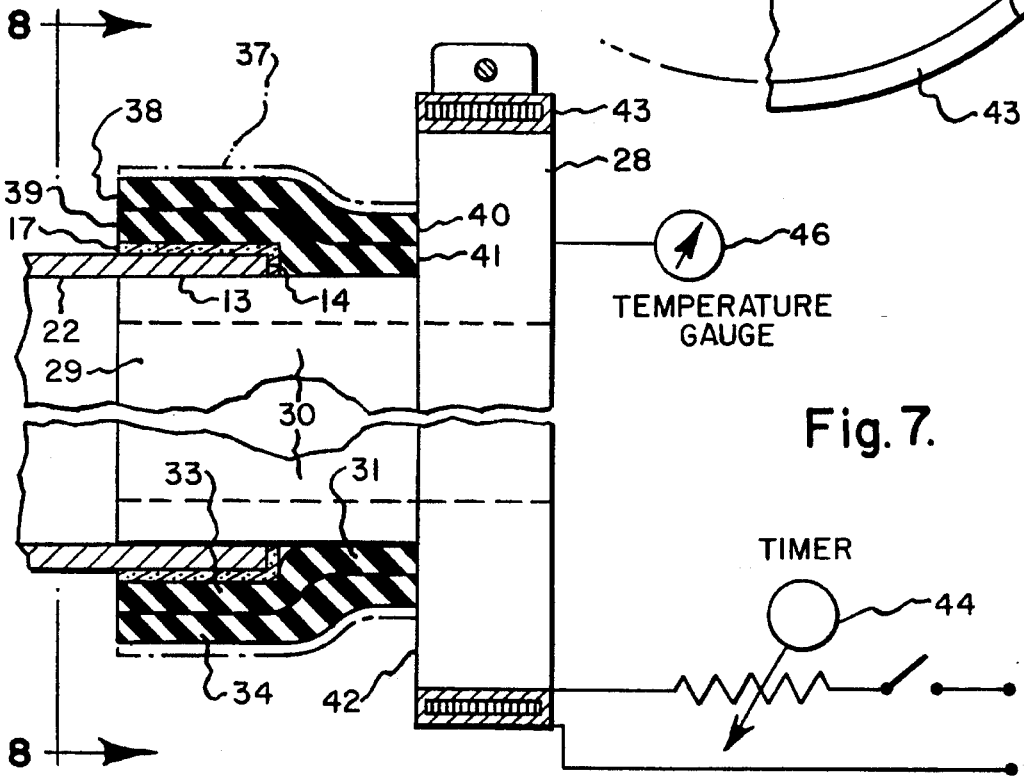
Fig. 7.

NICKEL PRINTING SLEEVE WITH PROTECTIVE HARD RUBBER RIMS

BACKGROUND OF THE INVENTION

The present invention relates to an improved nickel printing sleeve with hard rubber protective rims for preventing the cutting of the hands of workmen during handling and also preventing the splitting and crimping of the sleeve ends which could render the sleeves inoperable.

By way of background, nickel sleeves of about 0.005 and 0.007 inches thick are in common use in the printing industry for mounting on mandrels and carrying printing plates. Because of the sharp ends of the sleeves, it is not uncommon for workmen to be cut while handling them. In addition, because of the thinness of the sleeves, their ends are commonly susceptible to splitting and crimping which renders them useless. This is an economic waste, considering the fact that the sleeves are expensive. It is with overcoming the foregoing deficiencies of prior art nickel sleeves that the present invention is concerned.

SUMMARY OF THE INVENTION

It is one object of the present invention to provide protective rims which are securely bonded to the ends of nickel sleeves to thereby prevent the cutting of the hands of workmen who handle such sleeves.

Another object of the present invention to provide an improved nickel sleeve having hard rubber protective rims which tend to obviate the crimping and splitting of the sleeve ends which renders the sleeve useless.

A further object of the present invention is to provide a method of fabricating hard rubber ends onto nickel sleeves which can be practiced in a simple and expedient manner by the fabricators of such sleeves or which can be applied to existing sleeves in the field. Other objects and attendant advantages of the present invention will readily be perceived hereafter.

The present invention relates to a printing sleeve comprising a nickel sleeve having an inner surface and an outer surface and end portions and opposite ends, and hard rubber rims bonded to said outer surface at said end portions and including rim portions extending beyond said ends.

The present invention also relates to a method of bonding a rim to the end of a nickel printing sleeve comprising the steps of applying adhesive to the end portion of said sleeve, inserting a plug into said end portion of said sleeve while permitting a portion of said plug to extend beyond said end of said sleeve, winding a strip of unvulcanized hard rubber around said end portion of said sleeve and beyond said end of said sleeve and onto said portion of said plug which extends beyond said end of said sleeve, winding shrink-wrap about said strip of unvulcanized hard rubber, and heating said strip of unvulcanized hard rubber to cause said strip of unvulcanized hard rubber to cure and bond to said end portion of said sleeve.

The various aspects of the present invention will be more fully understood when the following portions of the specification are read in conjunction with the accompanying drawings wherein:

BRIEF DESCRIPTION OF THE DRAWINGS

FIG. 1 is a fragmentary side elevational view of a preferred embodiment of the improved printing sleeve of the present invention;

FIG. 2 is an end elevational view taken substantially in the direction of arrows 2—2 of FIG. 1;

FIG. 3 is an enlarged fragmentary cross sectional view taken substantially along line 3—3 of FIG. 1;

FIG. 4 is a fragmentary side elevational view of the improved printing sleeve of FIG. 1 with printing plates mounted thereon;

FIG. 5 is a fragmentary cross sectional view of an end of the nickel sleeve with a masking and supporting tube inserted therein and with adhesive applied to the end portion of the nickel sleeve and to the end thereof, thereby representing the first step in the process of bonding a hard rubber rim to both the end portion and end of the nickel sleeve;

FIG. 6 is a fragmentary view similar to FIG. 5 but showing the masking and supporting tube removed from the end of the nickel sleeve and schematically showing the inner surface being cleaned;

FIG. 7 is a fragmentary view of the next step in the process of bonding a protective rim to the end of the nickel sleeve which includes the insertion of a metal plug into the sleeve and winding layers of rubber stripping about the end portion of the metal sleeve and winding shrink-wrap about the rubber strip;

FIG. 8 is a cross sectional view taken substantially in the direction of arrows 8—8 of FIG. 7 and showing the manner in which the rubber strip has been wound around the end portion of the metal sleeve;

FIG. 9 is a fragmentary schematic view of the step of trimming the protective rim after it has been bonded to the metal sleeve;

DESCRIPTION OF THE PREFERRED EMBODIMENTS

Figure 10:
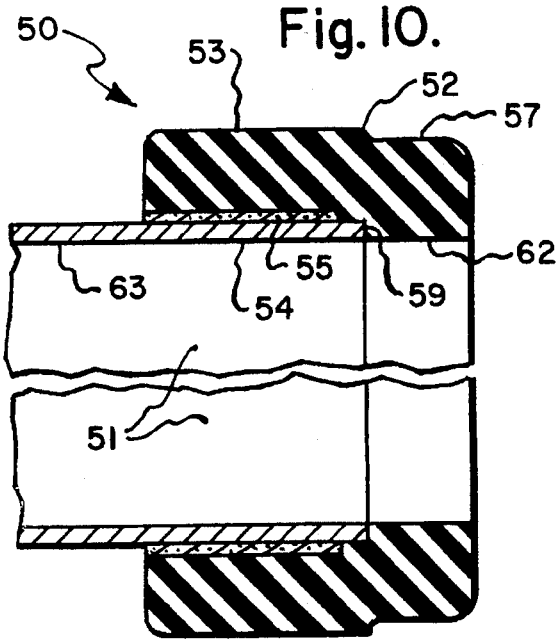
FIG. 10 is a fragmentary cross sectional view of a second embodiment of a sleeve with another type of protective rim fabricated by the method of FIGS. 11 and 12.

By way of introduction, the improved printing sleeve of the present invention overcomes certain deficiencies of the prior art by providing protective rims to the ends of the thin nickel sleeve to (1) prevent the cutting of the hands of workmen, and (2) prevent the splitting or crimping the ends of the sleeve which could render it useless.

The improved metal sleeve 10 of the present invention overcomes the foregoing deficiencies of the prior art by having hard rubber protective rims 11 bonded on the opposite end portions of metal sleeve 12 which conventionally is a nickel sleeve between 0.005 and 0.007 inches thick and which can have a length of up to about 12 feet. The metal sleeve 12 includes end portions 13 and ends 14. Protective rims 11 which are fabricated of vulcanized or cured hard rubber, are located at the ends of the sleeve. Portions 15 of rims 11 overlie sleeve end portions 13 and are bonded thereto by a layer 17 of suitable adhesive. The adhesive also extends onto sleeve ends 14 at 19, and rim portions 20, which extend beyond sleeve end portions 13, are also bonded to sleeve ends 14. The portion 15 of each rim 11 which overlies end portion 13 of the metal sleeve can have a dimension a which is about 0.25 inches. The rim portion 20 which extends beyond sleeve end portion 13 can have a dimension b which may be between about 0.060 to 0.125 inches. The thickness of the portion 15 of rim 11 which overlies end portion 13 of the sleeve is shown by dimension c which is about 0.040 inches. The thickness of the rim portions 20 which extend beyond the sleeve end portions 13 is denoted by dimension d which is about 0.040 inches. The inner surfaces 21 of rim portions 20 are substantially in line with the inner surface 22 of sleeve 12. The reason for limiting the dimension c to about 0.040 inches, that is, the amount that the rim portions 15 extend above the outer surface 23 of sleeve 12, is so that their outer surfaces 26 are lower than the outer surfaces 28 of printing plates, such as 24, which are secured to the outer surface 23 and which have a dimension e which is in excess of dimension c, which is 0.040 inches. It is to be noted that the foregoing dimensions are by way of example and not of limitation.

It is to be noted that because (1) portions 15 of the protective rims 11 are bonded to the outer surface 23 of sleeve 12 at end portions 13 and because (2) rim portions 20 are bonded to ends 14 of sleeve 12, protective rims 11 will reinforce the extreme ends 14 of nickel sleeve 12 against crimping and splitting. When compressed air is applied to the inner surfaces 21 of rims 11, these portions will expand in substantially the same manner and same amounts as the end portions 13 of nickel sleeve 12 so that sleeve 12 can be mounted and demounted from an associated mandrel as if protective rims 11 were not even present. The bond between ends 14 of the sleeve and rim portions 20 provides a continuity which causes rim end portions 20 and sleeve end portions 13 to act as an integral unit. In other words, metal sleeve 12 will function in operation relative to mounting and demounting from an associated mandrel in the same manner as if protective rims 11 were not present, yet rims 11 will provide the above advantages to sleeve 12, namely, the protection against crimping and splitting of the ends. While specific dimensions have been set forth above, it will be appreciated that the hard rubber rims can be of any suitable thickness which will still permit them to be expanded by air pressure used to mount the metal sleeve 12 on a mandrel, with the condition that they must project above the outer surface 23 of the sleeve less than the thickness of plates which are to be mounted on the outer surface.

The steps of bonding rims 11 to the end portions 13 and ends 14 of sleeve 12 are depicted in FIGS. 5–9. In this respect only one end of sleeve 12 is shown in these figures, and it will be appreciated that the other end is treated in the same manner.

The first step of the process is to insert an annular hollow masking and supporting tube 25 of cardboard or any other suitable material into the end portion 13 with a tight fit. Thereafter, a layer of adhesive 17 is applied to the outer cylindrical surface 23 at end portion 13 of the sleeve and also to annular end 14 of the sleeve. The purpose of using masking and supporting tube 25 is (1) to prevent the adhesive 17 from being applied onto the inner surface 22 of the sleeve at end portion 13 and (2) to support the sleeve during the process of applying the adhesive. In FIG. 6 the tube 25 has been removed from sleeve 12 and the inner surface 22 at end portion 13 is schematically shown as being cleaned by a suitable brush or abrading tool 27 to insure that there is no adhesive on inner surface 22. The brush 27 depicts the cleaning of the inner surface 22 proximate sleeve end 14.

After the procedures of FIGS. 5 and 6 have been effected, a metal plug 29 is inserted with a tight fit into sleeve 12 and it underlies sleeve end portion 13. As shown plug 29 includes an end portion 30 which is of substantially the same size as the inner diameter of sleeve 12 so that it fits tightly within inner surface 22. Plug 29 also has an enlarged annular portion 28. As shown plug 29 is hollow but it need not be.

After plug 29 has been inserted as shown, an unvulcanized hard rubber strip 31 is wound about end portion 13 of sleeve 12. This winding is effected in a lapped arrangement as depicted in FIG. 8. More specifically, the unvulcanized hard rubber strip is approximately 0.020 inches thick, and it is wound about sleeve end 13 in layers by starting at end 32 (FIG. 8), and the strip is then wound counterclockwise so that it forms an inner layer 33 and an outer layer 34. The end 35 of strip 31 is cut at 35 so that the end 35 lies substantially even with inner end 32. Thereafter, shrink-wrap 37 is wound about the layers of unvulcanized hard rubber strip 31. As can be seen from FIG. 7, the sides 38 and 39 of layers 33 and 34, respectively, are substantially in line and the sides 40 and 41, respectively, abut the side 42 of enlarged annular portion 28 of plug 29, although this need not necessarily be the case. It will be appreciated that there may be more than two layers of stripping, if desired, provided that the total thickness does not exceed a predetermined value.

After the shrink-wrap has been applied, the plug 29 is heated. In this respect, a band heater 43 is mounted on the outer surface of annular plug portion 28. This band heater may be of any suitable construction, and its purpose is to heat plug 29 so as to fuse the layers 33 and 34 of unvulcanized rubber strip 31 and cure and bond them. In this respect, the band heater is energized so that electric current is provided to the resistance heater therein to cause the rubber strip 31 to be heated to a temperature of about 240° F. for one hour. A temperature gauge 46 on plug 29 measures the temperature. A timer 44 sets the rheostat 45 to produce the above-mentioned 240° F. temperature for one hour. This temperature is the flow point where it softens and cross links the layers 33 and 34 to each other. The heating also causes the shrink-wrap to shrink to thus apply radial inward pressure to the rubber. Thereafter, the timer 44 adjusts the rheostat 45 to raise the temperature of the layers 31 and 34 to about 300° F. which bonds the adhesive and cures the rubber so that the rims 11 are thoroughly bonded to both the end portion 13 of sleeve 12 and to the end 14 of end portion 13. The bonding to end portion 14 is especially of interest considering that it is only between 0.005 and 0.007 inches thick. The rubber does not bond to plug 29 because there is no adhesive thereon. If desired, a plug with a non-stick surface may be used, or a non-stick surface may be applied to plug 29 to facilitate removal of the plug from the sleeve. After the heating process has terminated, the plug 29 is withdrawn and, as depicted in FIG. 9, the outer end portion 47 of rim 11 is trimmed by the use of a sharp instrument, such as razor 49. As noted above, the foregoing method of applying the rim 11 is effected at each end of sleeve 12, although the foregoing description was directed only to one end. While a band heater has been used, it will be appreciated that the heat may be supplied by any other suitable type of heater.

Summarizing and amplifying the foregoing, the method comprises the following steps. (1) Clean the outer surfaces of end portions 13 of the sleeve and ends 14. (2) Insert a cardboard mask or tube 25 to protect the inner surfaces of end portions 13 against the entry of adhesive. (3) Apply adhesive to the outer surfaces of end portions 13 and to ends 14. (4) Remove cardboard tube 25. (5) Clean inside surface 22 at end portions 13. (6) Insert plug 29. (7) Wind rubber strip 31 in the above-described manner. (8) Apply shrink tape and tape it down. (9) Energize the band heater. (10) Trim the outer end of rim 11.

The adhesive which is used is a polymer type adhesive and it is obtainable under the trademarks CHEMLOK 220, 238 or 252, and it will be understood that other comparable adhesives may be used. Before it is applied, a primer under the trademark CHEMLOK 205 is used. The hard rubber can be an EPDM compound or a natural or synthetic material having a Shore A durometer range of between 75 and 95 and preferably between 90 and 95. It should have a tensile strength of between about 2800 and 3000 psi, an elongation of between about 180% and 200% and should have a 100% modulus of stretchability of between about 2000 and 2500 psi. However, the hard rubber can have other parameters. The nylon shrink tape which was used is known as untreated natural nylon tape and it was 3⅜ inches wide times 0.012–0.013 inches thick.

In FIG. 10 a second embodiment 50 of an improved metal sleeve is shown. Only one end of the sleeve is shown, but it will be appreciated that both ends can have protective rims thereon. In the foregoing respect, metal sleeve 51 may be identical to metal sleeve 12 of FIGS. 1–9. A protective rim 52 has a portion 53 which overlies end portion 54 of sleeve 51 and is bonded thereto by a layer of adhesive 55. Protective rim 52 also has a portion 57 which extends outwardly beyond end 59 of sleeve 51. However, as can be seen from FIG. 10, the layer of adhesive does not extend over onto end 59 of metal sleeve 51.

Figure 11:
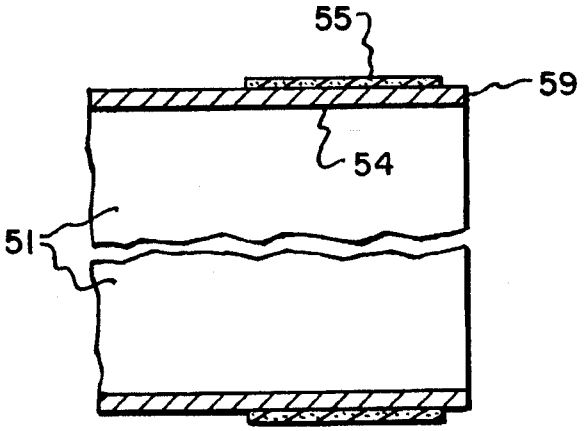
FIG. 11 is a fragmentary cross sectional view of the first step in the process of making a second embodiment of the improved printing sleeve of the present invention.
Figure 12:
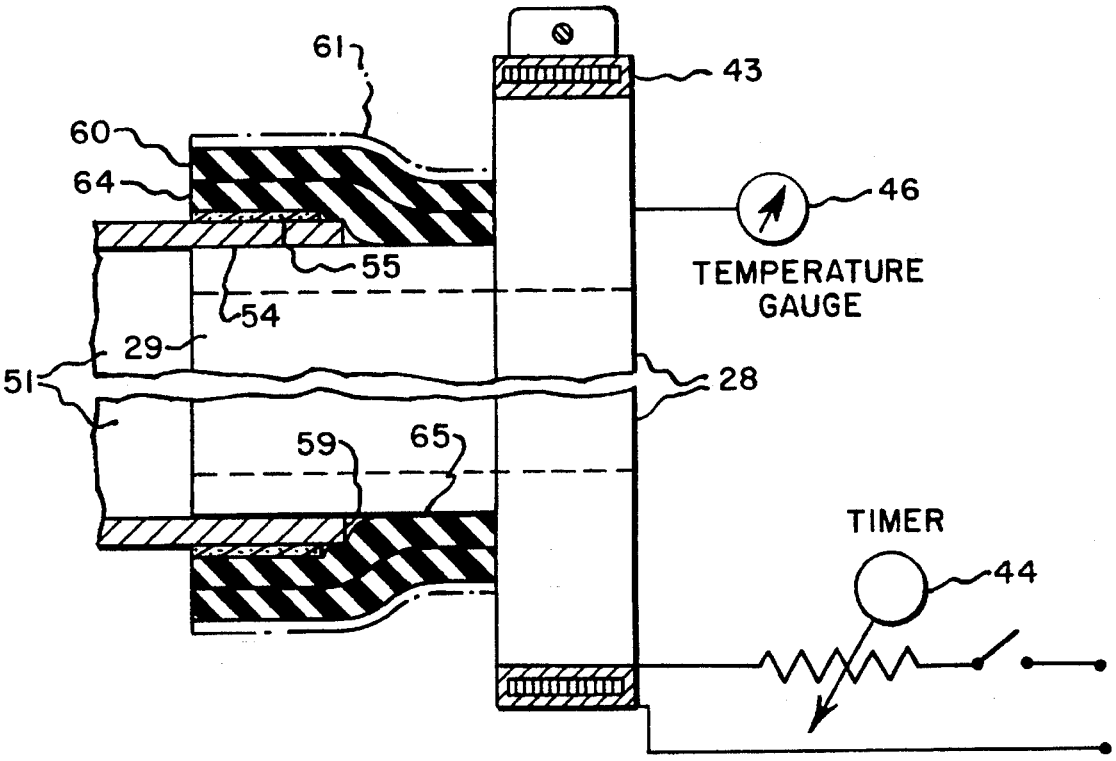
FIG. 12 is a fragmentary cross sectional view of a subsequent step in the process of making the second embodiment.

The method of fabricating the protective rim 52 of sleeve 50 is depicted in FIGS. 11 and 12. In this respect, a layer of adhesive 55 is applied to outer end portion 54 of sleeve 51. It is to be noted that layer 55 does not extend all the way to the actual end 59 of sleeve 54. Thereafter, a plug 29, which may be identical to plug 29 of FIG. 7, is inserted into sleeve 51 and a strip 60 of rubber is wound around end portion 54 and shrink-wrap 61 is wound around rubber strip 60. The winding of the rubber strip 60 and the shrink-wrap 61 may be in all respects identical to that described above relative to FIGS. 7 and 8. Thereafter, the band heater 43 on enlarged portion 28 of plug 29 is energized to heat and cure the rubber strip and bond it to the end portion 54 in the same manner as described above in detail relative to FIGS. 7 and 8. Actually the portions of the process of FIG. 12 are identical in all respects to that described above relative to FIGS. 7 and 8. The only difference is that the adhesive does not extend over onto the actual end 59 of sleeve 51. It will be appreciated that the adhesive 55 need not stop short of the actual end 59 but can extend all the way to end 59 but not onto end 59 in the embodiment of FIGS. 10–12.

In the embodiment of FIG. 10, after the hard rubber has been cured and formed as shown, the inner surface 62 of rim portion 57 will be in line with the inner surface 63 of sleeve 51. However, there will be no bonding of the protective rim at actual end 59. The reason that the protective rim 52 is formed as shown in FIG. 10 is because of both the pressure applied by the shrink-wrap and the deformation of the hard rubber during the heating process wherein it is softened, cross-linked and cured. In the foregoing respect, the inner layer 64 of the rubber, as shown in FIG. 12, does not lie in complementary mating relationship to the end portion 54 and end 59 of sleeve 51 when it is initially wound thereon. However, after the softening, cross-linking and curing, the inner portion of the protective rim 52 lies in complementary mating relationship to the end 59 and end portion 54 of sleeve 51, as shown in FIG. 10.

Figure 13:
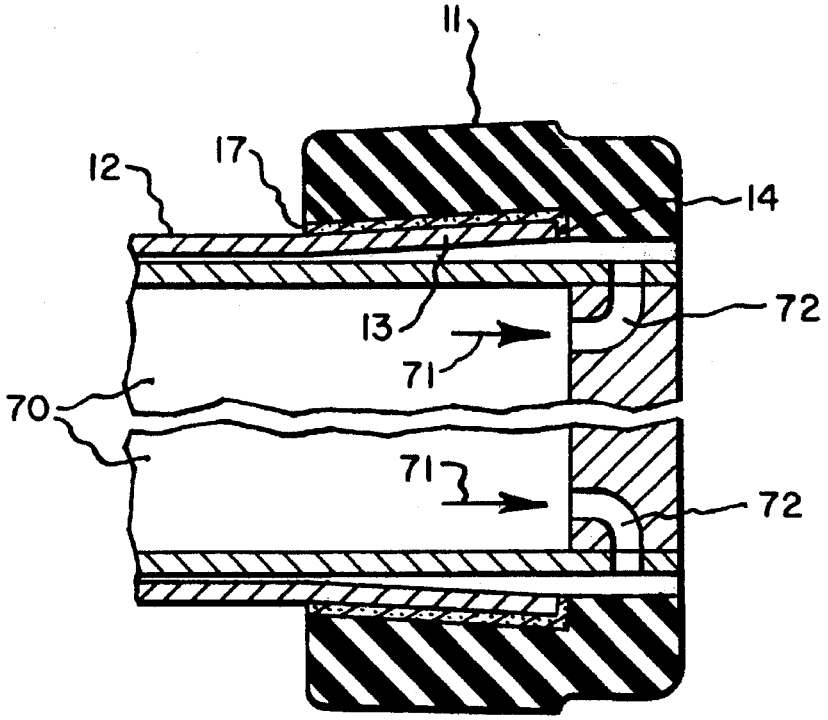
FIG. 13 is a fragmentary cross sectional view of the sleeve of FIG. 3 mounted on a mandrel of a particular type to which compressed air has been supplied.

In FIG. 13 the metal sleeve 12 of FIG. 3 having the protective rim 11 is shown mounted on an air mandrel 70 wherein compressed air can flow in the direction of arrows 71 through ducts 72 to expand sleeve 12. In this particular type of mandrel the protective rim 11 overlies ducts 72, and since it is bonded to end 14 of sleeve 12, the compressed air in raising protective rim 11 will also lift the end portion 13 of sleeve 12 away from air mandrel 70 so that sleeve 12 can be slid off of air mandrel 70. Thus, the protective rim 11 can overlie the ducts 72 and still cause the sleeve 12 to function as if its end portion 13 itself was in overlying relationship to ducts 72.

Figure 14:
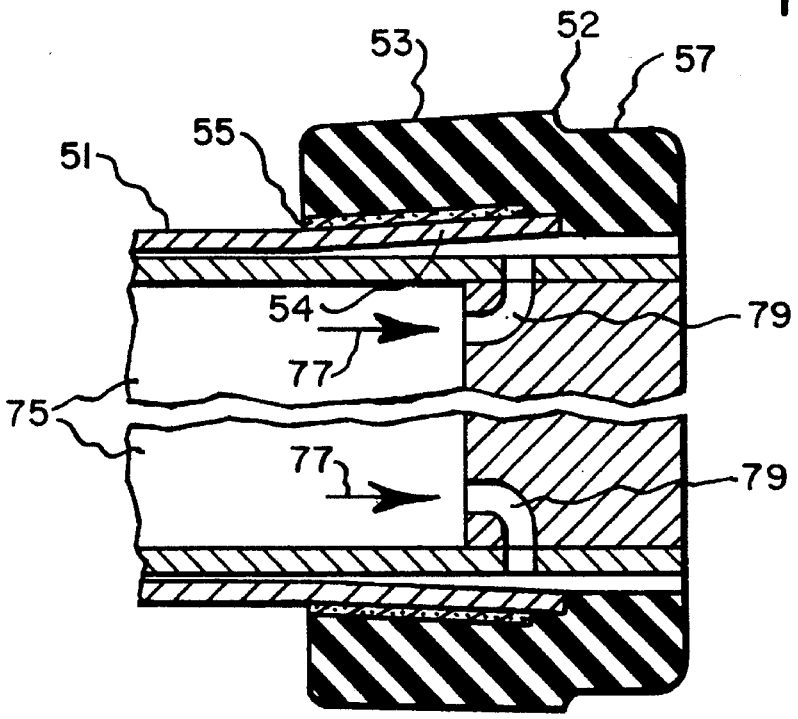
FIG. 14 is a fragmentary cross sectional view of the sleeve of FIG. 12 mounted on a mandrel of another type than shown in FIG. 13.

In FIG. 14 the sleeve 51 of FIG. 10 is shown having the protective rim 52 thereon in position on air mandrel 75 which is of a different type than air mandrel 70 of FIG. 13. In this embodiment, compressed air 77 flows through ducts 79 which underlie end portion 54 of sleeve 51. Thus, the end portion 57 of protective rim 52 need not be bonded to end 59 of sleeve 51 because it is not utilized to pull the end portion 54 of sleeve 51 away from the air mandrel. It is actually the compressed air acting on the sleeve end portion 54 which lifts the sleeve 51 during demounting.

Thus, while both the protective rim 11 of FIG. 3 and the protective rim 52 of FIG. 10 achieve both functions of protecting the hands of the workmen and protecting the end of the sleeve, they operate in slightly different ways on different types of mandrels. It will be appreciated that while it is preferred that the bonding of the protective rim be effected, as depicted in the embodiment of FIG. 3, it will be appreciated that the protective rim need not be as thoroughly bonded as shown in FIG. 3 but can be bonded to its associated sleeve as shown in FIG. 10 and it will still serve its intended functions and be operable when it is used in conjunction with an air mandrel, such as 75 of FIG. 14. In other words, the protective rims of FIG. 3 and FIG. 10 will both function satisfactorily on a mandrel of the type shown in FIG. 14 whereas the protective rim 11 of FIG. 3 must be used with a mandrel, such as 70 shown in FIG. 13. The foregoing is the case because if a sleeve, such as 51, with a protective rim, such as 52, were to be used on an air mandrel, such as 70, the overhanging portion 57 of the protective end 52 could pull away from the end 59 and leave a space such that the proper compressed air pressure would not be applied to lift the end portion of the sleeve away from the mandrel.

It will also be appreciated that it is especially desirable to have a protective rim at each end of a metal sleeve for the above purposes of protecting the hands of the workmen and the ends of the sleeve. However, it is quite possible that in certain circumstances only one end of the nickel sleeve need carry a protective rim when that is the only end which is being handled in use and the other end is not being subjected to stresses which could cause it to be crimped or to split.

While preferred embodiments of the present invention have been disclosed, it will be appreciated that it is not limited thereto but may be otherwise embodied within the scope of the following claims.

What is claimed is:

1. A printing sleeve comprising a nickel sleeve having an inner surface and an outer surface and end portions and opposite ends, and hard rubber rims bonded to said outer surface at said end portions and including rim portions extending beyond said ends.

2. A printing sleeve as set forth in claim 1 wherein said rim portions include inner surfaces which are substantially in line with said inner surface of said sleeve.

3. A printing sleeve as set forth in claim 2 wherein said nickel sleeve is between about 0.005 and 0.007 inches thick.

4. A printing sleeve as set forth in claim 3 wherein said hard rubber rims are also bonded to said ends of said sleeve.

5. A printing sleeve as set forth in claim 3 wherein said hard rubber rims are an EPDM compound.

6. A printing sleeve as set forth in claim 1 wherein said hard rubber rims are an EPDM compound having a Shore A hardness of between about 75 and 95.

7. A printing sleeve as set forth in claim 1 wherein said hard rubber rims are an EPDM compound having a Shore A hardness of between about 90 and 95.

8. A printing sleeve as set forth in claim 1 wherein said hard rubber rims are also bonded to said ends of said sleeve.

9. A printing sleeve as set forth in claim 7 wherein said rim portions include inner surfaces which are substantially in line with said inner surface of said sleeve.

10. A printing sleeve as set forth in claim 1 wherein said rim portions which extend beyond said ends are not larger than about 0.040 inches thick.

11. A printing sleeve as set forth in claim 10 wherein said nickel sleeve is between about 0.005 and 0.007 inches thick, and wherein said portions of said rims overlying said end portions of said sleeve are not larger than about 0.040 inches thick.

12. A printing sleeve as set forth in claim 11 wherein said rims are an EPDM compound.

13. A printing sleeve as set forth in claim 11 wherein said hard rubber rims are an EPDM compound having a Shore A hardness of between about 85 and 95.

14. A printing sleeve as set forth in claim 11 wherein said hard rubber rims are an EPDM compound having a Shore A hardness of between about 90 and 95.

15. A printing sleeve comprising a nickel sleeve having an inner surface and an outer surface and end portions and opposite ends, hard rubber rims bonded to said outer surface at said end portions and having rim portions extending beyond said opposite ends of said nickel sleeve and bonded to said opposite ends, and said rims being expandable by air pressure in substantially the same manner and substantially the same amount as said nickel sleeve.

16. A printing sleeve comprising a nickel sleeve having an inner surface and an outer surface and end portions and opposite ends, and at least one hard rubber rim bonded to said outer surface at one of said end portions and including a rim portion extending beyond said end.

17. A printing sleeve as set forth in claim 14 wherein said rim portion includes an inner surface which is substantially in line with said inner surface of said sleeve.

18. A printing sleeve as set forth in claim 16 wherein said at least one hard rubber rim is also bonded to said end of said sleeve.

19. A printing sleeve comprising a nickel sleeve having an inner surface and an outer surface and end portions and opposite ends, and at least one hard rubber rim bonded to said outer surface at one of said end portions and having a rim portion extending beyond one of said opposite ends of said nickel sleeve and bonded to said one opposite end, and said rim being expandable by air pressure in substantially the same manner and substantially the same amount as said nickel sleeve.

20. A method of bonding a rim to the end portion of a nickel printing sleeve having an end adjacent said end portion comprising the steps of applying adhesive to the end portion of said sleeve and to the end of said sleeve, inserting a plug into said end portion of said sleeve while permitting a portion of said plug to extend beyond said end of said sleeve, winding a strip of unvulcanized hard rubber around said end portion of said sleeve and beyond said end of said sleeve and onto said portion of said plug which extends beyond said end of said sleeve, winding shrink-wrap about said strip of unvulcanized hard rubber, and heating said plug to cause said strip of unvulcanized hard rubber to cure and bond to said end portion and to said end of said sleeve.

21. A method as set forth in claim 20 including the step of masking the inside of said end portion of said sleeve prior to applying said adhesive.

22. A method as set forth in claim 21 including the step of cleaning the inside of said end portion of said sleeve prior to inserting said plug.

23. A method as set forth in claim 17 wherein said winding step comprises the winding of a plurality of layers of said strip onto and beyond said end portion of said sleeve, and wherein said heating step comprises a first step wherein said layers are caused to flow into each other and a second step wherein said adhesive is activated to bond said hard rubber to said sleeve and to cure said rubber.

24. A method as set forth in claim 23 including the additional steps of removing said plug, and trimming the outer end of said hard rubber.

25. A method of bonding a rim to the end portion of a nickel printing sleeve having an end adjacent said end portion comprising the steps of applying adhesive to the end portion of said sleeve, inserting a plug into said end portion of said sleeve while permitting a portion of said plug to extend beyond said end of said sleeve, winding a strip of unvulcanized hard rubber around said end portion of said sleeve and beyond said end of said sleeve and onto said portion of said plug which extends beyond said end of said sleeve, winding shrink-wrap about said strip of unvulcanized hard rubber, and heating said plug to cause said strip of hard rubber to cure and bond to said end portion of said sleeve.

26. A method as set forth in claim 25 wherein said winding step comprises the winding of a plurality of layers of said strip onto and beyond said end portion of said sleeve, and wherein said heating step comprises a first step wherein said layers are cuased to flow into each other and a second step wherein said adhesive is activated to bond said hard rubber to said sleeve and to cure said rubber.

27. A method as set forth in claim 26 including the additional steps of removing said plug, and trimming the outer end of said hard rubber.

* * * * *